US011692698B1

(12) United States Patent
Chen

(10) Patent No.: US 11,692,698 B1
(45) Date of Patent: Jul. 4, 2023

(54) LED LIGHTING TAPE SYSTEM

(71) Applicant: Sikai Chen, Delran, NJ (US)

(72) Inventor: Sikai Chen, Delran, NJ (US)

( * ) Notice: Subject to any disclaimer, the term of this patent is extended or adjusted under 35 U.S.C. 154(b) by 0 days.

(21) Appl. No.: 18/062,150

(22) Filed: Dec. 6, 2022

(51) Int. Cl.
*F21V 23/06* (2006.01)
*F21S 4/10* (2016.01)

(52) U.S. Cl.
CPC ..... *F21V 23/06* (2013.01); *F21S 4/10* (2016.01)

(58) Field of Classification Search
CPC ..... F21V 23/06; F21S 4/10; F21S 4/00; F21S 4/24; F21S 4/22
See application file for complete search history.

(56) References Cited

U.S. PATENT DOCUMENTS 10,378,747 B1 * 8/2019 Hanslip ..... H05B 45/20

FOREIGN PATENT DOCUMENTS

CN 112780961 A * 5/2021
WO WO-2014091657 A1 * 6/2014 ..... F21K 9/232
WO WO-2022085411 A1 * 4/2022

* cited by examiner

*Primary Examiner* — Anabel Ton
(74) *Attorney, Agent, or Firm* — Stuart M. Goldstein

(57) ABSTRACT

An LED lighting tape system has an elongated flexible band supporting a plurality of LED lamps. A positively charged pin member is fitted into and is contact with the inner surface of one of the plurality of holes and a positively charged solder material component. A negatively charged pin member is fitted into and is in contact with the inner surface of one of the plurality of holes and a negatively charged solder material component. An electrical power source provides electricity through wiring extending through the positively and negatively charged pin members, such that electricity is transmitted through the wiring, to the pin members, and ultimately to the positively and negatively charged solder material component in order to illuminate the LED lamps.

10 Claims, 6 Drawing Sheets

LED LIGHTING TAPE SYSTEM

FIELD OF THE INVENTION

The present invention relates generally to LED lighting tapes, and more particularly to lighting tapes which are configured to receive electrical power from a number of locations along the tape itself.

BACKGROUND OF THE INVENTION

Light emitting diode (LED) lighting tapes are commonly utilized to provide illumination in a variety of dark and unlit locations, including tight and enclosed spaces. Lighting tapes are beneficial as they are relatively flexible, easy to install, and inexpensive to manufacture. Yet they have significant drawbacks.

Current LED lighting tapes receive electricity through positive and negative wiring which enters at a single location through the lighting tape. Wiring is routinely attached by solder at the end of the tape. As a result, this limits the manner electricity is transmitted to the lighting tape, and thus also greatly restricts how lighting tapes can be positioned and adjusted for attachment in and around angled, smaller, and tight spaces. That they can receive electricity from only one, limited location, is also a critical disadvantage.

SUMMARY OF THE INVENTION

It is thus the object of the present invention to provide an LED lighting tape system which overcomes the limitations and disadvantages of prior systems.

This and other objects are accomplished by the present invention, an elongated flexible band supporting a plurality of LED lamps. A first plurality of holes on and extending through the band, each hole being circumscribed by electrically conductive positively charged solder material component. A second plurality of holes being circumscribed by electrically conductive negatively changed solder material component. An electrically conductive positively charged pin member is fitted into and is contact with the inner surface of one of the plurality of holes and the positively charged solder material component. An electrically conductive negatively charged pin member is fitted into and is in contact with the inner surface of one of the plurality of holes and the negatively charged solder material component. An electrical power source provides electricity through conductive wiring from the positively charged pin member and the negatively charged pin member. Electricity is received through the wiring, to the positively and negatively charged pin members, and ultimately to the positively and negatively charged solder material in order to illuminate the LED lamps.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
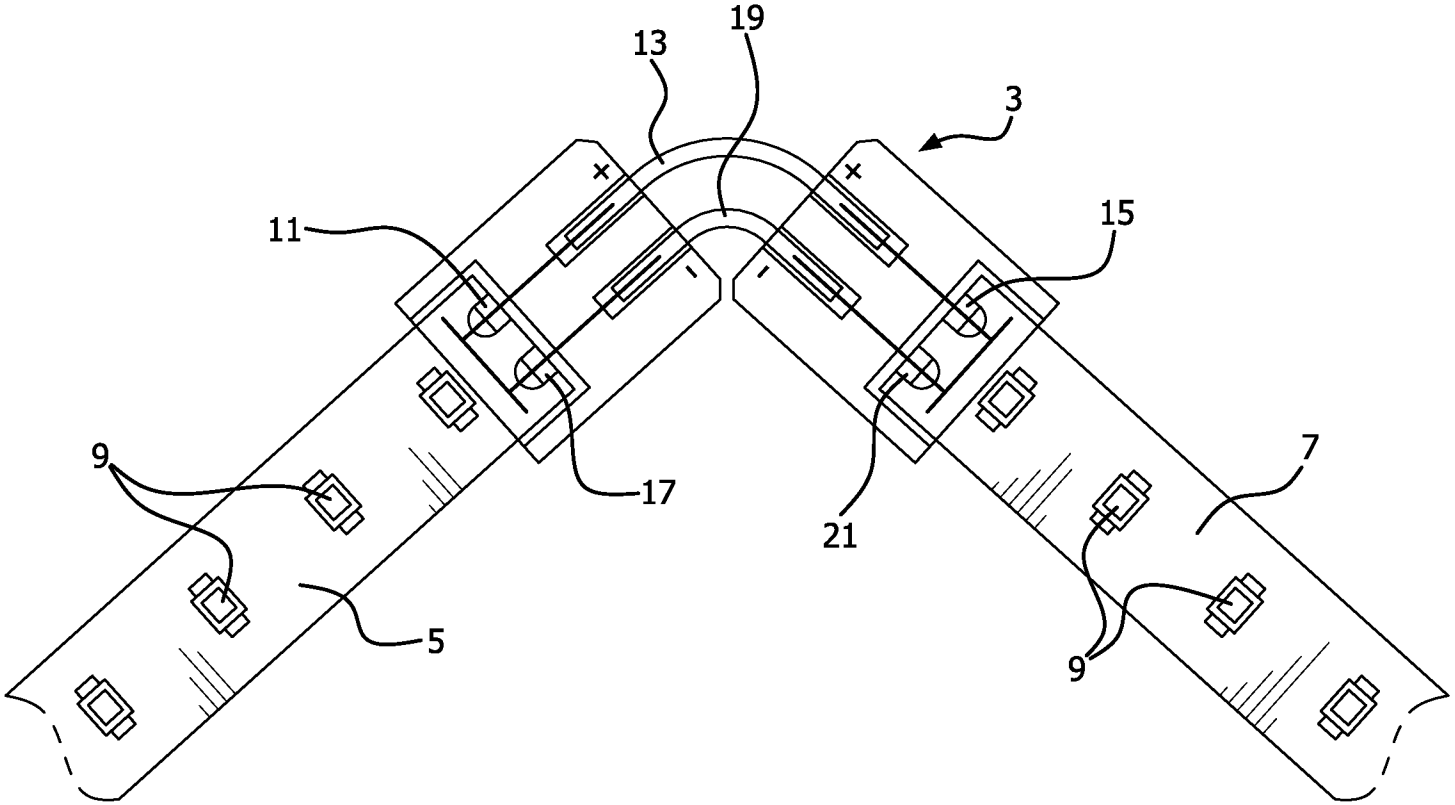
FIG. 1 (Prior Art)
FIG. 1 illustrates the current manner in which electricity is transmitted to LED lamps mounted on LED lighting tapes.
Figure 2:
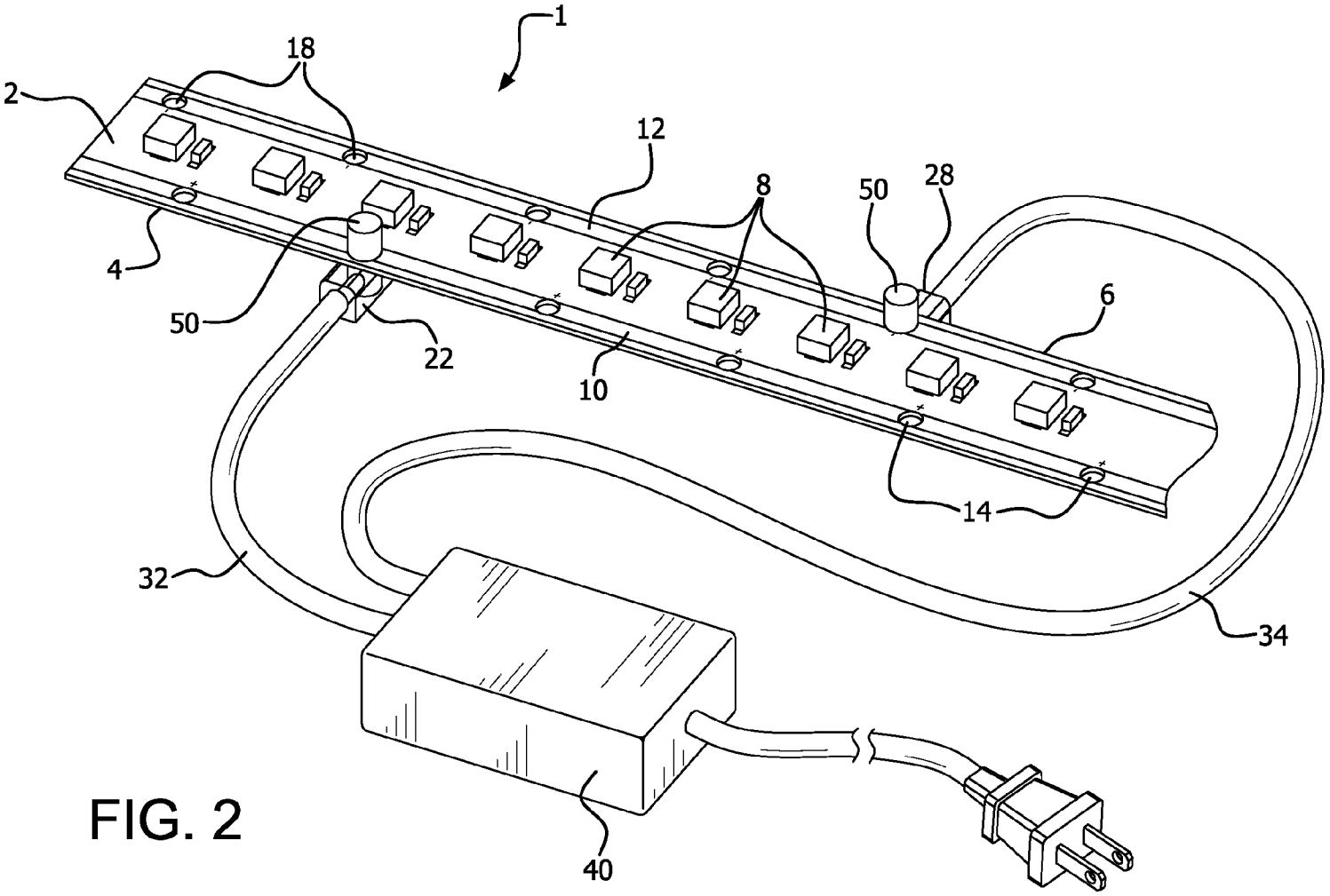
FIG. 2 shows a first embodiment of the LED lighting tape system of the present invention.
Figure 3:
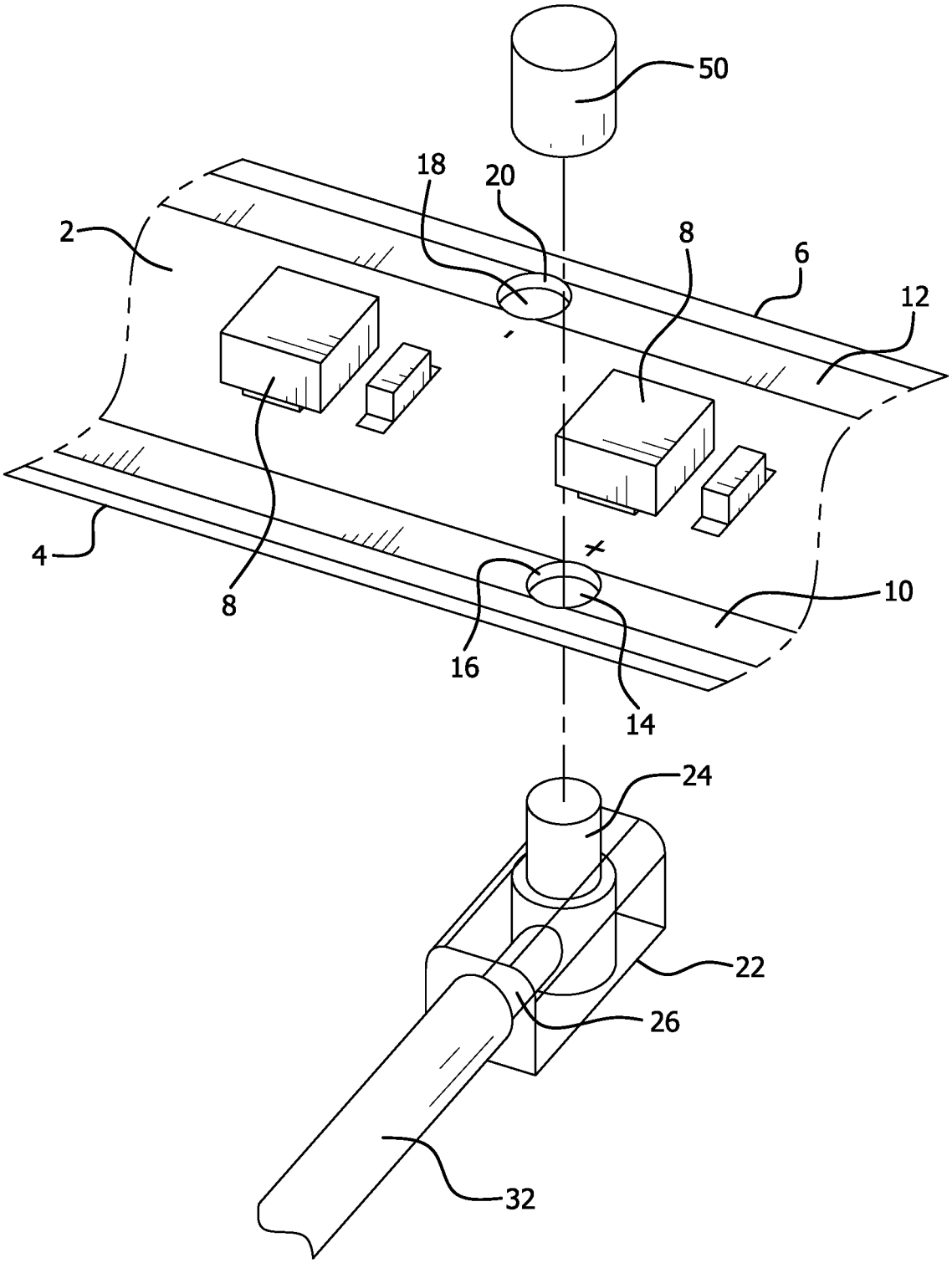
FIG. 3 is an exploded view of the flexible band, positively and negatively charged solder material strips, and pin member with cover, components of the first embodiment of the LED lighting tape system of the present invention.
Figure 4:
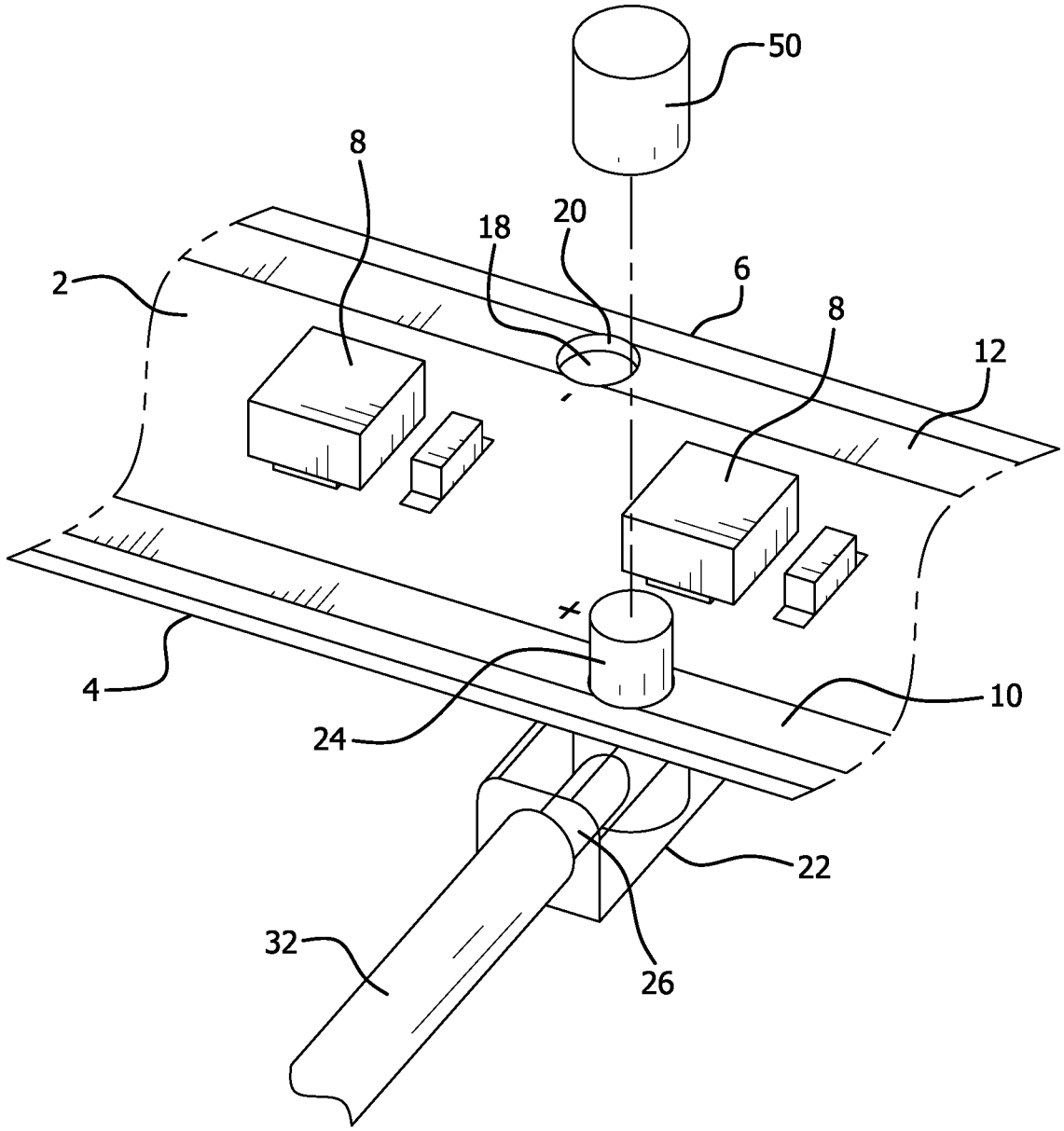
FIG. 4 is a view similar to FIG. 3, but showing the pin member through a hole, the flexible band, and the positively charged solder material strip of the LED lighting tape system of the present invention.

FIG. 1 shows the current manner in which electricity is transmitted via a single, fixed electrical connection to LED lamps mounted on lighting tapes. LED lighting tape system 3 comprises lighting tapes 5 and 7 interconnected and providing electricity to LED lamps 9 by means of positive wiring 13 and negative wiring 19, via electric contacts 11 and 17 on tape 5 and electric contacts 15 and 21 on tape 7. It is clear that prior lighting tape systems, as illustrated in FIG. 1, are severely limited as electrical connections are restricted solely to designated end sections of the tape.

On the other hand, the present invention allows electrical connection along many different locations along the band of the lighting tape. For instance, LED lighting tape system 1 comprises flexible band 2 having first lateral edge 4 and second lateral edge 6. Band 2 supports a plurality of LED lamps 8. Electrically conductive positively charged solder material component in the form of strip 10 extends along and is adjacent to lateral edge 4. Electrically conductive negatively charged solder material component in the form of strip 12 extends along and is adjacent to lateral edge 6. Holes 14 with inner surfaces 16 are circumscribed by strip 10 and extend through band 2 and the strip. Holes 18 with inner surfaces 20 extend and are circumscribed by strip 12 and through band 2 and the strip.

Electrically conductive positively charged pin member 22 comprises first upwardly extending arm section 24 and second arm section 26 extending laterally from the first arm section. Electrically conductive negatively charged pin member 28, identical to pin member 22, also has first and second arm sections.

Covers 50 are provided in order to protect first arm section 24 of pin member 22 and the first arm section of pin member 28. Covers 50 also assist in maintaining the first arm section 24 of pin member 22 and the first arm section of pin member 28 in holes 14 and 18.

Positive electrical conductive wiring 32 is attached to first arm section 24 of pin member 22 and extends from the pin member to power source 40. Negative electrical conductive wiring 34 is attached to first arm section of pin member 28 and extends from the pin member to the power source.

In operation, pin member 22 fits into hole 14 such that it is in contact with inner surface 16 of the hole where it is fused to solder material strip 10. Pin member 28 fits into hole 18 such that it is in contact with inner surface 20 of the hole where it is fused to solder material strip 12. Electricity from power source 40 is transmitted through wiring 32 and 34 to pin members 22 and 28 respectively and then is sent through the pin members to strips 10 and 12. Via electric circuitry well known in the art, the electricity is then sent from strips 10 and 12, where it is ultimately received by and illuminates LED lamps 8.

The placement and number of available holes 14 and 18 through strips 10 and 12 on band 2 allows electric power to be provided at numerous locations on the band. This results in the ability to cut band 2 into different sizes and to form the band into a variety of positions, allowing LED lighting tape system 1 the versatility of use which is not afforded with prior LED lighting tapes.

Figure 5:
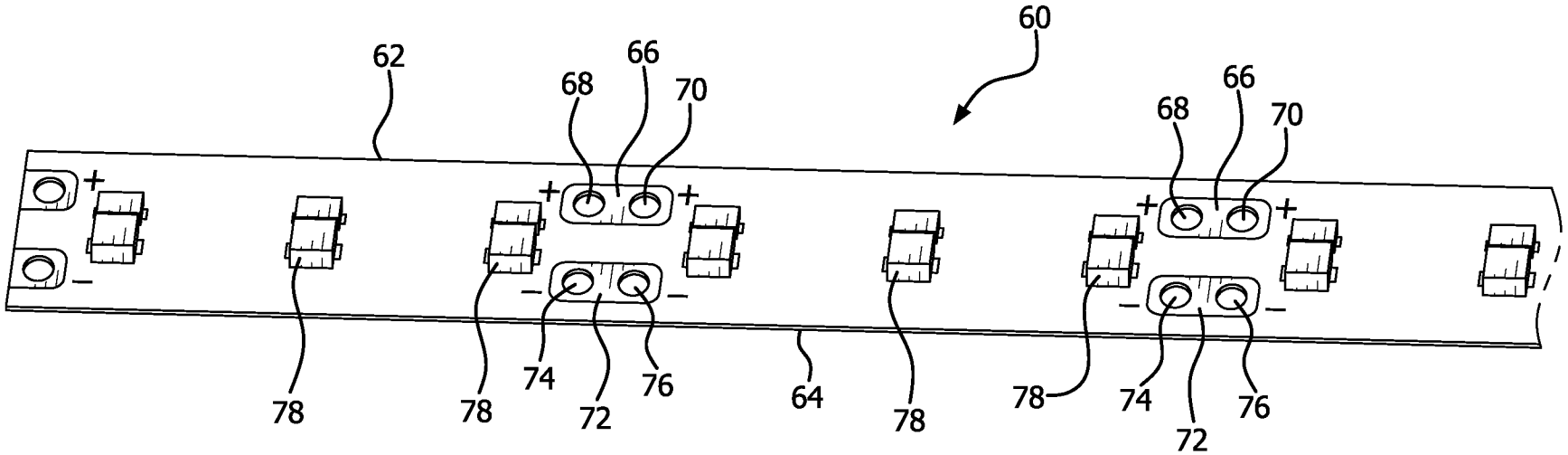
FIG. 5 is a second embodiment of the LED lighting tape system of the present invention.
Figure 6:
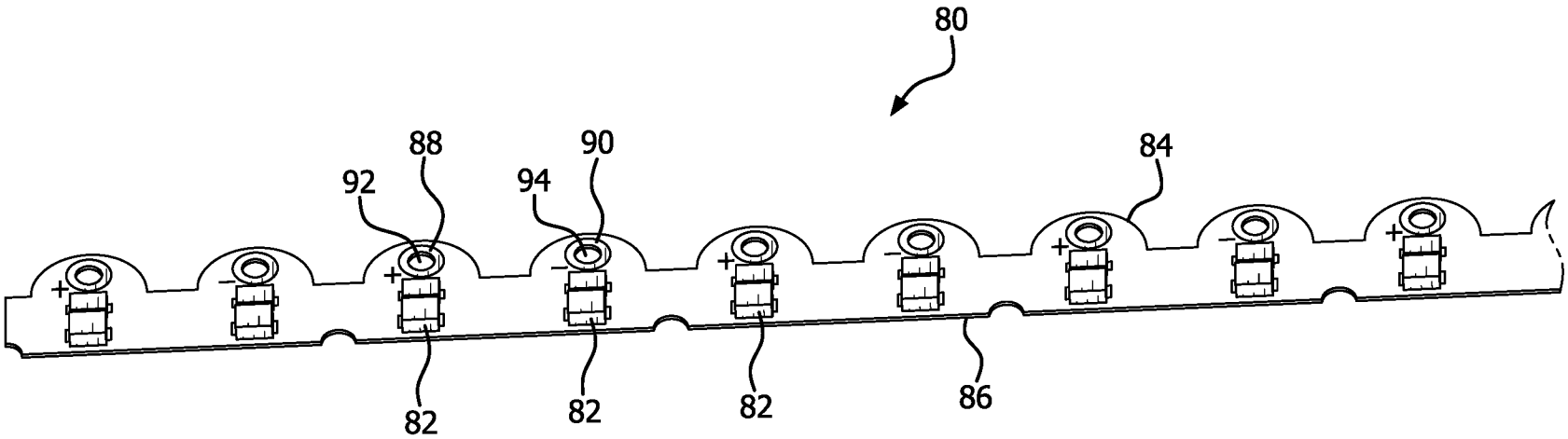
FIG. 6 is a third embodiment of the LED lighting tape system of the present invention.

FIGS. 5 and 6 show alternate embodiments of the invention. In FIG. 5, lighting tape system 60 has LED lamps 78 and first lateral edge 62 and second lateral edge 64. Electrically conductive positively charged solder material components in the form of truncated strips 66 are located along and adjacent to lateral edge 62 and circumscribe holes 68 and 70. Electrically conductive negatively charged solder material components in the form of truncated strips 72 are located along and adjacent to lateral edge 64 and circumscribe holes 74 and 76.

In FIG. 6, lighting tape system 80 has LED lamps 82, first lateral edge 84, and second lateral edge 86. Electrically conductive positively and negatively charged solder material components in the form of rings 88 and 90, respectively, circumscribe holes 92 and 94 along only lateral edge 84.

Pin members 22 and 28 are also utilized in the embodiments shown in FIGS. 5 and 6. Electricity is sent from power source 40 in the same manner as previously described with regard to the first embodiment, through pin members 22 and 28, to illuminate lamps 78 and 82.

It is contemplated that the solder material used for strips 10 and 12, truncated strips 66 and 72, rings 88 and 90, and all other comparably shaped solder material components can be fabricated by any type of electrically conductive solder material.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An LED lighting tape system comprising:

an elongated flexible band supporting a plurality of LED lamps;

a first plurality of holes on and extending through the band, said plurality of holes being circumscribed by an electrically conductive positively charged solder material component;

a second plurality of holes on and extending through the band, said second plurality of holes being circumscribed by an electrically conductive negatively charged solder material component;

an electrically conductive positively charged pin member fitted into and in contact with one of the plurality of holes and the positively charged solder material component;

an electrically conductive negatively charged pin member fitted into and in contact with one of the plurality of holes and the negatively charged solder material component;

a power source providing electrical power; and electrically conductive wiring extending from the positively charged pin member and from the negatively charged pin member to the power source; wherein electricity from the power source is transmitted through the wiring, the positively and negatively charged pin members, and to the positively and negatively charged solder material components in order to illuminate the LED lamps.

2. The system as in claim 1 wherein each of the pin members has a first arm member and a second arm member, the first arm member being fitted into and in contact with one of the plurality of holes and solder material components circumscribing the holes, and the second arm member being attached to the wiring.

3. The system as in claim 1 further comprising a protective cover encasing each of the first arm members of the pin members.

4. The system as in claim 1 wherein the positively charged pin member is fused to the positively charged solder material component and the negatively charged pin member is fused to the negatively charged solder material component.

5. The system as in claim 1 wherein the band has first and second lateral edges, the electrically conductive positively charged solder material component is a strip extending along and adjacent to the first lateral edge, and the electrically conductive negatively charged solder material component is a strip extending along and adjacent to the second lateral edge.

6. The system as in claim 5 wherein the positively charged pin member is fused to the positively charged strip and the negatively charged pin member is fused to the negatively charged strip.

7. The system as in claim 1 wherein the band has first and second lateral sides, both the first and second plurality of holes being located on the first lateral side and wherein the positively charged solder material components are rings which circumscribe the first plurality of holes and the negatively charged solder material components are rings which circumscribe the second plurality of holes.

8. The system as in claim 7 wherein the positively charged pin member is fused to a positively charged ring and the negatively charged pin member is fused to a negatively charged ring.

9. The system as in claim 1 wherein the band has first and second lateral edges, the electrically conductive positively charged solder material component is a truncated strip which circumscribes two of the first plurality of holes located along and adjacent to the first lateral edge, and the electrically conductive negatively charged solder material component is a truncated strip which circumscribes two of the second plurality of holes located along and adjacent to the second lateral edge.

10. The system as in claim 9 wherein the positively charged pin member is fused to the positively charged truncated strip and the negatively charged pin member is fused to the negatively charged truncated strip.

* * * * *